US005781114A

United States Patent [19]

Chang

[11] Patent Number: 5,781,114

[45] Date of Patent: Jul. 14, 1998

[54] RECHARGEABLE BATTERY SET WITH RESCUE ALARM AND ELECTRIC SHOCK FUNCTIONS

[75] Inventor: Hshiu-Fang Chang, No. 65, Sec. 4, PaTe Road, Taipei City, Taiwan

[73] Assignee: Hshiu-Fang Chang, Taipei, Taiwan

[21] Appl. No.: 741,871

[22] Filed: Oct. 28, 1996

[51] Int. Cl.[6] ..... G08B 15/00; G08B 13/02

[52] U.S. Cl. ..... 340/574; 307/150; 340/693; 361/232

[58] Field of Search ..... 340/574, 693; 307/150; 361/232; 119/908; 231/7

[56] References Cited

U.S. PATENT DOCUMENTS 4,486,807 12/1984 Yanez ..... 361/232
4,719,454 1/1988 Hopkins et al. ..... 340/574
4,968,034 11/1990 Hsieh ..... 273/84 ES
5,392,029 2/1995 Chang ..... 340/574
5,467,247 11/1995 De Anda et al. ..... 361/232
5,578,992 11/1996 Harding ..... 340/574

*Primary Examiner*—Glen Swann
*Attorney, Agent, or Firm*—Meltzer, Lippe, Goldstein, et al.

[57] ABSTRACT

A rechargeable battery set includes a power supply encased in a housing, a rescue alarm electrically connected to and powered by the battery via a switch so that when the switch is turned on, sounds of high decibels are generated and emitted by a speaker or buzzer incorporated inside the housing and a pair of retractable electrodes arranged within the housing to be electrically connected to the power supply via a high voltage generation circuit under the control of the switch and manually extendible out of the housing to provide an electric shock for user's body protection purpose. A flash generator is also mounted within the housing and connected to the power supply to generate a flash signal for rescue purpose.

6 Claims, 3 Drawing Sheets

RECHARGEABLE BATTERY SET WITH RESCUE ALARM AND ELECTRIC SHOCK FUNCTIONS

FIELD OF THE INVENTION

The present invention relates to a rechargeable battery set, such as those used to power mobile phones, and in particular to a rechargeable battery set having rescue alarm and electric shock function for user's body protection.

BACKGROUND OF THE INVENTION

Mobile phones have been widely used nowadays, especially in urban areas. Mobile phones are powered by rechargeable battery sets. Very often, besides the battery set that is mounted to and being used to power the mobile phone, at least one spare battery set is also carried. Conventionally, the battery sets are only for powering the mobile phones and provides no other functions. Since the battery set not only occupies space, but also has quite a weight which increases the load that the user of mobile phone has to take, it is desirable to provide the battery set with functions other than just powering the mobile phone by making use of the electrical power stored therein.

SUMMARY OF THE INVENTION

The principal object of the present invention is to provide a rechargeable battery set that, besides just powering an electrical appliance, such as a mobile phone, has other functions by making use the electrical energy stored therein.

It is another object of the present invention to provide a rechargeable battery set having a rescue alarm which when actuated generates sound of high decibels for calling for help.

A further object of the present invention is to provide a rechargeable battery set having retractable electrodes for the generation of electrical shock to serve as a self-protection device when one is violated or attacked.

In accordance with the present invention, there is provided a battery set comprising a power supply encased in a housing, a rescue alarm electrically connected to and powered by the battery via a switch so that when the switch is turned on, sounds of high decibels are generated and emitted by a speaker or buzzer incorporated inside the housing and a pair of retractable electrodes arranged within the housing to be electrically connected to the power supply via a high voltage generation circuit under the control of the switch and manually extendible out of the housing to provide an electric shock for user's body protection purpose. A flash generator is also mounted within the housing and connected to the power supply to generate flash signal for rescue purpose.

BRIEF DESCRIPTION OF THE DRAWINGS

The present invention will be better understood from the following description of a preferred embodiment thereof, with reference to the attached drawings, wherein.

DETAILED DESCRIPTION OF THE PREFERRED EMBODIMENT

Figure 1:
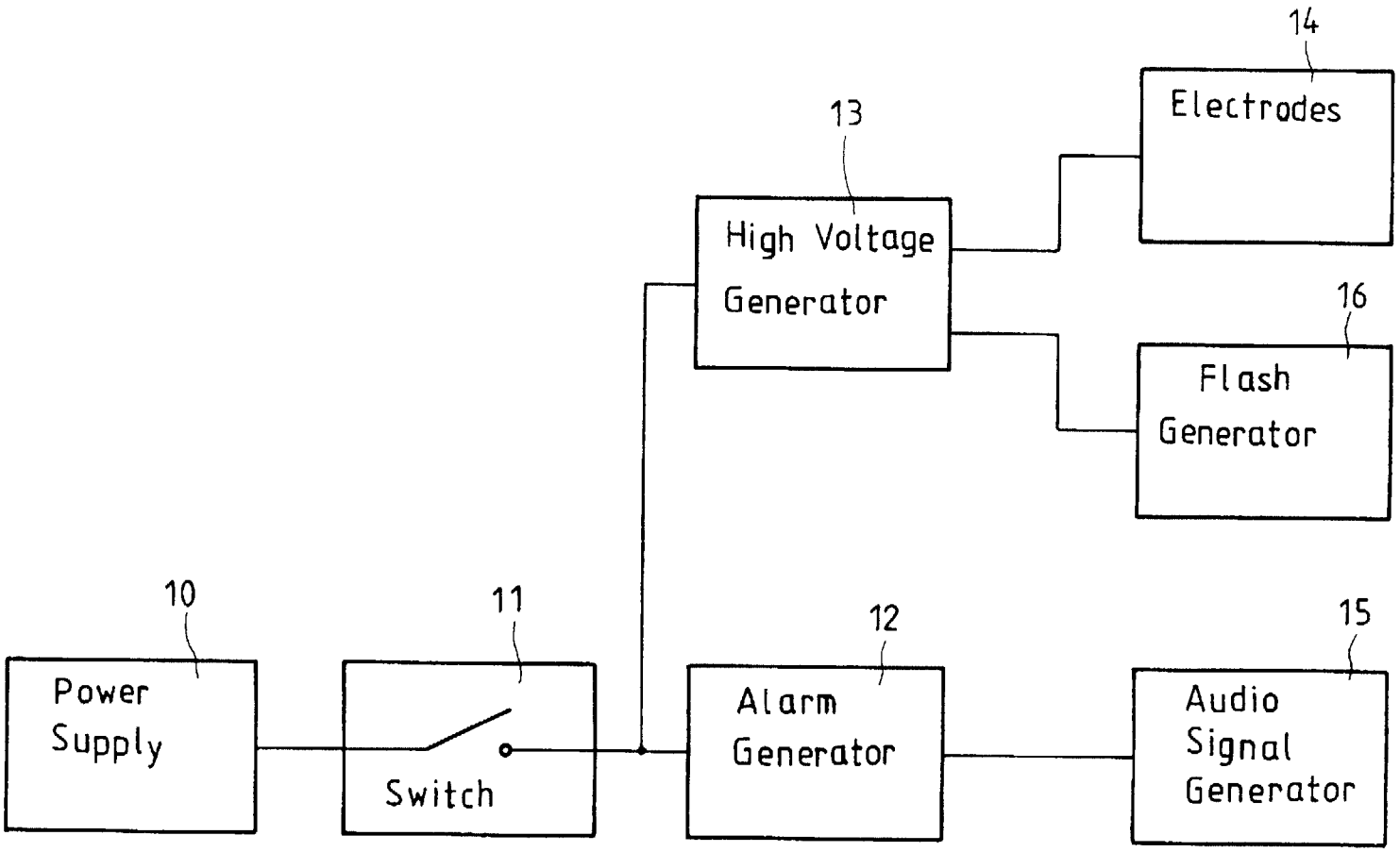
FIG. 1 is a block diagram of circuit of the rescue alarm and the electrical shock generated by a rechargeable battery set constructed in accordance with the present invention.

With reference to the drawings and in particular to FIG. 1 which shows a block diagram of the circuit in accordance with the present invention, the circuit of the present invention comprises a power supply 10, which is encased inside a housing 20 to constitute a rechargeable battery set 100 (see FIGS. 2 and 3) and into which the circuit is incorporated, a manual switch 11, an alarm generator 12 which is electrically connected to the power supply 10 via the switch 11 so that when the switch 11 is turned on, the alarm generator 12 is powered. An audio signal generator 15, such as a speaker or a buzzer, is connected to the alarm generator 12 so that when the alarm generator 12 is actuated, the audio signal generator 15 generates and emits sounds of high decibels for rescue purpose.

The circuit of the present invention further comprises a high voltage generator 13 which is in parallel with the alarm generator 12 and electrically connected to the power supply 10 via the switch 11 so that when the switch 11 is turned on, the high voltage generator 13 receives electricity of low voltage and high current from the power supply 10 and converts the electricity into a high voltage but low current. The high voltage, lower current electricity is transmitted to a pair of electrodes 14 that are spaced from each other, also see FIG. 3, to generate electrical shock for user's body protection purpose.

Preferably, a flash signal generator 16 is also connected to the high voltage generator 13 to generate flashing, also for rescue purpose.

Figure 2:
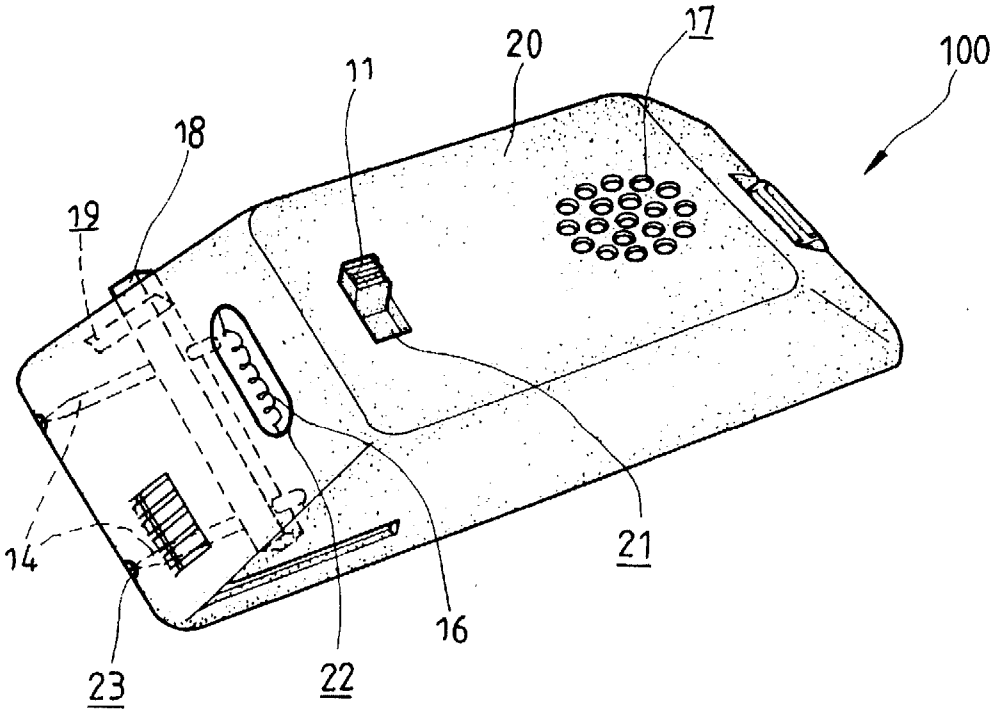
FIG. 2 is a perspective view showing the rechargeable battery set in accordance with the present invention.
Figure 3:
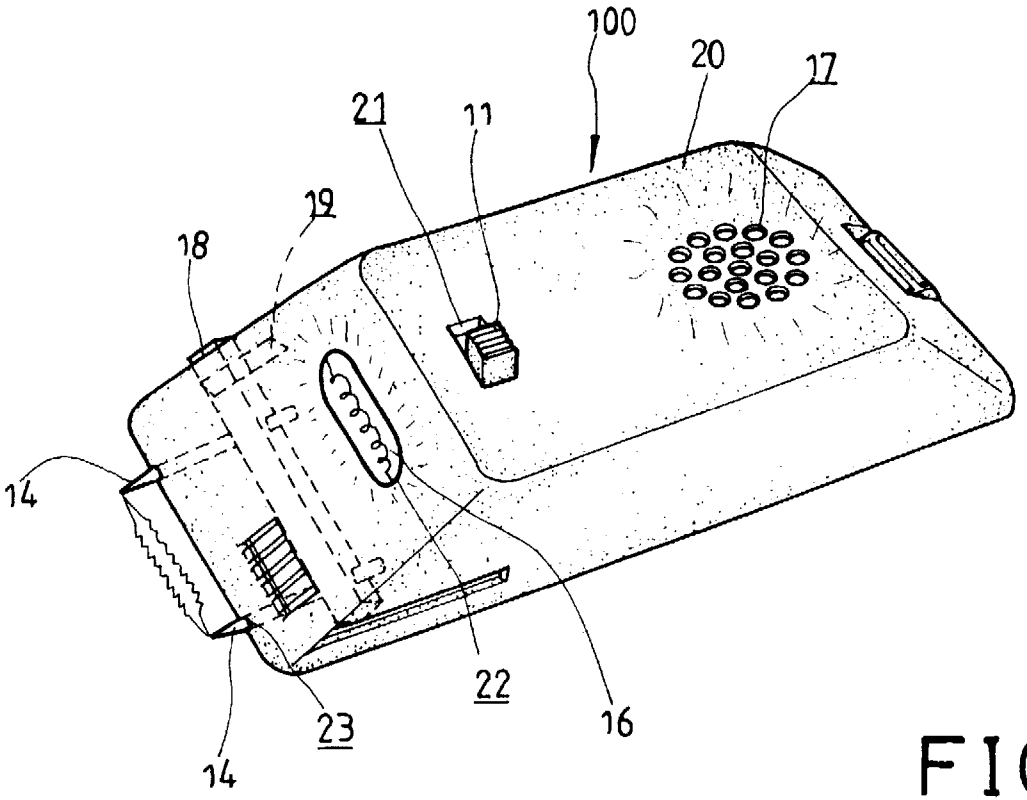
FIG. 3 is a perspective view showing the rechargeable battery set of the present invention wherein the shock electrodes are extended outside the battery set to perform electrical shock function.

With particular reference to FIGS. 2 and 3, wherein a rechargeable battery set constructed in accordance with the present invention, generally designated with reference numeral 100, is shown, the rechargeable battery set 100 comprises the housing 20 inside which a power source or supply is encased as a regular battery set. The battery set 100 also incorporates the circuit for the generation of the audio and video rescue signals and the electric shock.

The housing 20 comprises a plurality of apertures 17 adjacent the audio signal generator 15 mounted therein to allow the audio signal (sounds of high decibels) generated by the generator 15 to emit out of the housing 20.

The housing 20 also has a slot 21 to receive the switch 11 therein and to allow the switch 11 to be accessible by a user. The switch 11 is movable between a first position where the switch 11 is turned on and a second position where the switch 11 is turned off.

The housing 20 is provided with an opening 22 through which the flashing signal generated by the flash generator 16 is allowed to emit out of the housing.

The retractable electrodes 14 are movably received within the housing 20 and fixed to and supported on a bar 18 made of insulation material. The bar 18 has an end extending out of the housing 20 through an opening 19 to be manually driven to move the electrodes 14 between an extended position (FIG. 3) and a retracted position (FIG. 2). The electrodes 14 are received within the housing 20 and movable by the bar 18 to selectively extend out of the housing 20, as shown in FIG. 3, via two openings 23 formed on the housing 20 for the generation of electric shock for user's body protection.

The movable arrangement of the electrodes 14 is to have the electrodes 14 to be completely shielded within the housing 20 when not in use in order not to accidently hurt the user.

The battery set of the present invention provides user's body protection and rescue functions without significant modification of the outside contour of the regular battery set so that it not only provides the function of power supply, but also have additional functions of rescue and user self-protection.

Although a preferred embodiment has been described to illustrate the present invention, it is apparent that changes and modifications in the specifically described embodiment can be carried out without departing from the scope of the invention which is intended to be limited only by the appended claims.

What is claimed is:

1. A rechargeable battery set comprising a power supply encased within a housing, an alarm generator disposed within the housing and in electrical connection with the power supply via a manually actuatable switch to generate an audio signal via an audio signal generator when the switch is turned on and a pair of electrodes retractably disposed within the housing and manually extendable out of the housing, the electrodes being electrically connected to the power supply via a high voltage generator which is in turn connected to the power supply via the switch so that when the switch is turned, a high voltage is supplied to the electrodes to generate an electrical shock therebetween, wherein the electrodes are further fixed to and supported on a bar made of insulation material and movably received within the housing, the bar having an end extending out of the housing to be manually movable so as to selectively move the electrodes out of the housing through openings formed on the housing.

2. The rechargeable battery set as claimed in claim 1, wherein the audio signal comprises sounds of sufficiently high decibels for rescue purpose.

3. The rechargeable battery set as claimed in claim 1, wherein the audio signal generator comprises a speaker.

4. The rechargeable battery set as claimed in claim 1, wherein the audio signal generator comprises a buzzer.

5. The rechargeable battery set as claimed in claim 1, further comprising a flash signal generator electrically connected to the high voltage generator so as to generate a flashing signal when the switch is turned on.

6. The rechargeable battery set as claimed in claim 5, wherein the housing comprises an opening through which the flashing signal is emitted out of the housing.

* * * * *